US011187218B2

(12) United States Patent
Vieira et al.

(10) Patent No.: US 11,187,218 B2
(45) Date of Patent: Nov. 30, 2021

(54) TWO STAGE AIR COMPRESSOR

(71) Applicant: SCHULZ COMPRESSORES LTDA., Joinville (BR)

(72) Inventors: Giovani Eduardo de Souza Vieira, Joinville (BR); Fabiano Alves Dencker, Joinville (BR)

(73) Assignee: SCHULZ COMPRESSORES LTDA, Joinville (BR)

( * ) Notice: Subject to any disclaimer, the term of this patent is extended or adjusted under 35 U.S.C. 154(b) by 280 days.

(21) Appl. No.: 16/314,160

(22) PCT Filed: Jun. 29, 2017

(86) PCT No.: PCT/BR2017/050170

§ 371 (c)(1),
(2) Date: Dec. 28, 2018

(87) PCT Pub. No.: WO2018/000070

PCT Pub. Date: Jan. 4, 2018

(65) Prior Publication Data

US 2020/0332785 A1 Oct. 22, 2020

(30) Foreign Application Priority Data

Jun. 30, 2016 (BR) ..... 102016015357 3

(51) Int. Cl.
*F04B 25/00* (2006.01)
*F04B 39/06* (2006.01)
(Continued)

(52) U.S. Cl.
CPC ..... *F04B 25/005* (2013.01); *F04B 27/005* (2013.01); *F04B 39/06* (2013.01);
(Continued)

(58) Field of Classification Search
CPC ..... F04B 25/005; F04B 39/06; F04B 39/122; F04B 39/064; F04B 39/066; F04B 39/121;
(Continued)

(56) References Cited

U.S. PATENT DOCUMENTS 1,024,919 A 4/1912 Waterous
2,030,759 A 2/1936 Bob
(Continued)

FOREIGN PATENT DOCUMENTS

FR 346459 A 1/1905
FR 932953 A 4/1948
(Continued)

OTHER PUBLICATIONS

Definition—Elbow. McGraw-Hill Dictionary of Engineering—Second Edition (Year: 2003).*

*Primary Examiner* — Essama Omgba
*Assistant Examiner* — Christopher J Brunjes
(74) *Attorney, Agent, or Firm* — Dinsmore & Shohl LLP

(57) ABSTRACT

The compressor presents a first and a second cylinder block arranged in V and defining, respectively, a first and a second cylinder, and being affixed on a base block, each cylinder housing a respective piston driven by a crankshaft which is housed and supported on the base block. The first and the second cylinder block incorporate, respectively, a first and a second duct portion having an outer end open to the interior of the cylinder head of the respective cylinder, and an inner end open to a third duct portion incorporated to the base block, said duct portions forming a compressed air duct connecting the first cylinder to the second cylinder.

15 Claims, 6 Drawing Sheets

(51) Int. Cl.
*F04B 39/12* (2006.01)
*F04B 27/00* (2006.01)

(52) U.S. Cl.
CPC ..... *F04B 39/066* (2013.01); *F04B 39/121* (2013.01); *F04B 39/122* (2013.01); *F04B 39/123* (2013.01); *F05B 2210/12* (2013.01)

(58) Field of Classification Search
CPC ..... F04B 39/123; F04B 27/005; F04B 27/04; F04B 2210/16; F04B 2210/12; F04B 25/27; F04B 25/04; F04B 53/08
See application file for complete search history.

(56) References Cited

U.S. PATENT DOCUMENTS 2,576,876 A 11/1951 Gamble
2,765,976 A * 10/1956 Stewart ..... F04B 27/053 417/243
4,560,327 A * 12/1985 Bez ..... F01B 31/00 417/493
5,020,973 A * 6/1991 Lammers ..... F04B 39/066 417/243
5,033,940 A * 7/1991 Baumann ..... F04B 53/147 417/273
2005/0175469 A1* 8/2005 Lucchi ..... F04B 25/005 417/234
2006/0110263 A1* 5/2006 Seo ..... F04B 39/0253 417/244
2013/0323101 A1* 12/2013 Lucchi ..... F04B 39/12 417/437
2021/0017974 A1* 1/2021 Lin ..... F04B 27/005

FOREIGN PATENT DOCUMENTS

GB 2329681 A * 3/1999 ..... F04B 39/064
GB 2329681 A 3/1999
JP S5387410 U 7/1978
JP H062652 A 1/1994
WO 2011094975 A1 8/2011

* cited by examiner

TWO STAGE AIR COMPRESSOR

CROSS-REFERENCE TO RELATED APPLICATIONS

The present application is the National Phase entry of International Patent Application No. PCT/BR2017/050170 filed Jun. 29, 2017, which claims priority to Brazilian Patent Application No. 10 2016 015357 3 filed on Jun. 30, 2016, the disclosures of which are both hereby incorporated by reference into this application.

TECHNICAL FIELD

The present disclosure refers to an air compressor having two stages provided with two cylinders, which are connected to each other by an air duct, and defined in respective cylinder blocks arranged in V and incorporated on a base block, in which is usually defined the crankcase of the compressor, when the latter is of the type which uses lubricant oil and houses a crankshaft driven by an electric motor external to the base block.

BACKGROUND

There are well known in the art the two stage air compressors having the basic characteristics described above, but presenting some inconveniences which affect, for example, the manufacture cost, mainly due to the number of component parts needed for the formation of these compressors, which present a reduced degree of compaction.

Said compressors present other deficient aspects, such as: limited refrigeration degree of the lubricant oil for reducing or delaying the oxidation thereof, when the compressor is of the type which uses lubricant oil; the undesired air temperature differential, between the first and the second compression stage, jeopardizing the energetic efficiency of the compressor, due to the limitations in the refrigeration degree of the cylinder blocks; and also the difficulty in obtaining a homogeneous distribution of heat through the compressor body.

Documents U.S. Pat. Nos. 5,020,973 and 2,576,876 refer to two stage air compressors which present two V cylinder blocks, mounted on a base block which houses the crankshaft with the usual counterweight. Said two prior constructions present the air duct, which communicates the outlet of the first stage cylinder with the inlet of the second stage cylinder, formed as a separate piece totally external to the cylinder blocks and to the base block, requiring an extra part to be mounted and reducing the compaction degree of the compressor.

Document U.S. Pat. No. 1,024,919 refers to a hydraulic pump formed in a single block, comprising two V cylinder blocks incorporated, as a single piece, on a base block, said cylinder blocks incorporating, in a single piece, internal passages which lead to admission chambers and to discharge chambers through respective valves. Although presenting a single block incorporating fluid admission and fluid discharge internal passages, this prior solution does not refer to an air compressor with two stages interconnected through an air duct. Thus, although presenting a single block, it does not lead to the technical effects of compaction and homogeneous heat distribution through the compressor body, including external additional elements projecting upwardly from the pump body.

Another known construction is described in French patent FR932953 which refers to an hydraulic pump formed in a single piece, comprising two V cylinder blocks incorporated in a single piece on a base block, with the cylinder blocks incorporating, in a single piece, fluid admission and fluid discharge internal passages. Despite presenting a single block incorporating fluid admission and fluid discharge internal passages, this prior solution also does not refer to a compressor with two stages interconnected through an air duct, therefore not producing the necessary technical effects for an efficient operation of a two stage air compressor.

Document U.S. Pat. No. 2,030,759 describes an air compressor with only one stage, but presenting V cylinders formed as a single block mounted on a base block, each cylinder block portion incorporating, in the sidewall thereof, a refrigerant fluid circulating chamber. While illustrating cylinder block portions incorporating cooling chambers, this prior compressor does not present any air duct formed internally to the block portions, in order to interconnect two stages and remain spaced from each adjacent compression chamber by a pneumatic cooling chamber.

As it can be noted, the known solutions which use a compressor or pump block, in a single piece or in multiple pieces, and having two stages in V cylinders, do not present constructive characteristics capable of guaranteeing, simultaneously, an adequate compaction of the assembly, an adequate refrigeration of the lubricant oil in the base block, a reduced temperature differential of the fluid which is compressed or pumped from the first stage to the second stage, and an adequate temperature homogenization of the compressor/pump assembly.

SUMMARY

Due to the drawbacks mentioned above and related to the known construction solutions, it is an object of the present disclosure to provide a two stage air compressor in the form of cylinder blocks, which are arranged in V and incorporated on a base block, presenting a compact construction, guaranteeing an adequate refrigeration degree of the lubricant oil when existent, an adequate temperature differential of the fluid passing from the first to the second stage, and also a homogeneous distribution of heat through the compressor structure.

In order to achieve the generic object mentioned above, the present disclosure proposes a two stage air compressor, having a first and a second cylinder block, which are affixed on a base block, which defines a crankcase with an eventual lubricant oil and which houses and supports a crankshaft.

According to the present disclosure, the first and the second cylinder block incorporate, respectively, a first and a second duct portion having an outer end open to the interior of a cylinder head, which closes the cylinder defined in each cylinder block, and an inner end turned to the base block which incorporates, in a single piece, a third duct portion connecting the inner ends of the first and of the second duct portion and forming, therewith, a compressed air duct connecting the cylinder of the first compression stage to the cylinder of the second compression stage.

The construction defined above allows eliminating any external duct for connecting the two stages of the compressor, reducing its external dimensions, as well as the number of mounting parts thereof, and maintaining, at the same time, the third duct portion in direct contact with the lubricant oil of the crankcase, in the compressors which use lubricant oil, allowing the latter to remove heat from the compressed air being transferred from the first to the second compression stage, transferring the heat absorbed by the lubricant oil to a refrigeration air flow passing by the exterior of the cylinder blocks and of the base block.

BRIEF DESCRIPTION OF THE DRAWINGS

The present disclosure will be described below, with reference being made to the appended drawings, given by way of example of a possible construction for the present air compressor, and in which.

DETAILED DESCRIPTION

Figure 1:
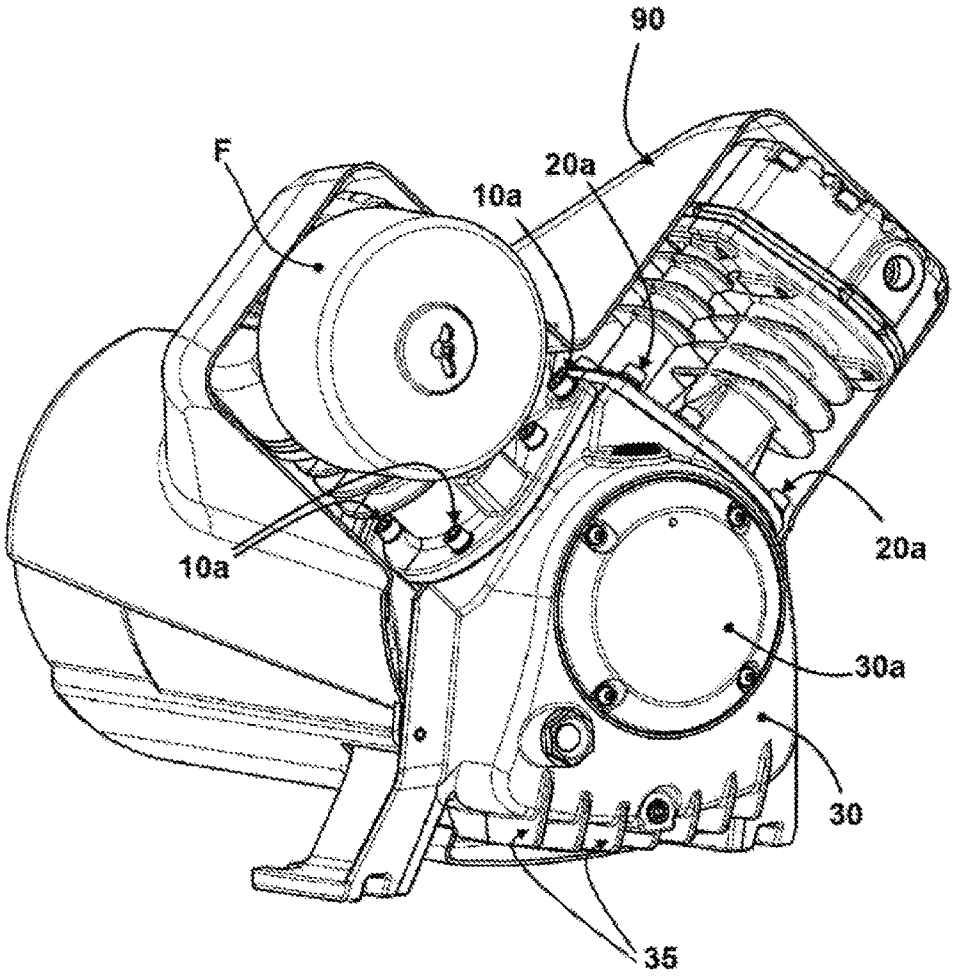
FIG. 1 represents an end perspective view of the air compressor of the present disclosure, surrounded by a protecting fairing.

As already commented and illustrated in the appended drawings, the present air compressor is of the type provided with two stages, having a first and a second cylinder block, 10,20, which are arranged in "V", defining, respectively, a first and a second cylinder C1, C2 and being affixed on a base block 30, said cylinders being usually cast in metallic material generally used in this type of machine, the first and the second cylinder block 10,20 being seated and affixed, usually through bolts, 10*a*, 20*a*, against respective open upper regions of the base block 30.

The base block 30 defines a crankcase 40 containing lubricant oil, each cylinder C1, C2 having a free end closed by a valve plate PV1, PV2 *e* and by a cylinder head 50, 60, each cylinder head 50, 60 defining a respective suction chamber 51, 61, and a discharge chamber 52, 62, each cylinder C1, C2 housing a respective piston P1, P2, to be displaced, in a reciprocating movement, by a crankshaft 70, which is housed and rotatively supported on the base block 30.

In the illustrated construction, the base block 30 has an outer end closed by a lid 30*a*, and the opposite end closed by an end wall 32, which is annularly shaped to define a housing for the first rolling bearing R1, said end wall 32 carrying a support 33 spaced from the latter and affixed thereon through longitudinal struts 34, the support 33 having an annular shape, defining, in its central region and turned to an end wall 32, a housing for a second rolling bearing R2.

The first and the second rolling bearing R1, R2 support end portions of the crankshaft 70, having an inner end 70*a* penetrating into the interior of the base block 30 and carrying an eccentric shaft portion 71 around which are mounted the larger eyes of the connecting rods B1, B2, whose smaller eyes are respectively coupled to the first piston P1 and to the second piston P2.

The median portion of the crankshaft 70, defined between the first and the second rolling bearing R1, R2, carries the rotor 81 of an electric motor 80, whose stator 82 has its ends affixed, respectively, to the end wall 32 of the base block 30 and to the support 33.

The crankshaft 70 presents an outer end 70*b* which projects beyond the support 33 to receive a fan V of radial flow and which, with the rotation of the motor 80, produces an air flow in the axial direction and passing through the motor 80 and around the base block 30, to be released in the end region of the latter, around the lid 30*a*.

The mounting arrangement of the electric motor 80 of the crankshaft 70 *e* and of the fan V, as described above and illustrated in the appended drawings, represents only one exemplary mounting arrangement, which should not be understood herein as limiting the fundamental aspects of the present disclosure to be described below.

According to the present disclosure, the first and the second cylinder block 10, 20 incorporate, respectively, in a single piece, a first and a second duct portion 11, 21, having an outer end 11*a*, 21*a*, open to the interior of the cylinder head 50, 60 of the respective cylinder C1, C2, and an inner end 11*b*, 21*b*, turned to the base block 30.

The base block 30 incorporates, on its turn and also in a single piece, a third duct portion 31 connecting the inner ends 11*b*, 21*b*, of the first and of the second duct portion 11, 21, and forming, therewith, a compressed air duct CA connecting the discharge chamber 52 of the first cylinder C1 to the suction chamber 61 of the second cylinder C2.

In the illustrated construction, the first and the second duct portions 11, 21, are disposed, longitudinally, along the respective cylinder block 10, 20, between an external wall portion 12, 22 of the latter, turned to the other cylinder block 10, 20, and the respective cylinder C1, C2, the third duct portion 31, in the form of a 90° elbow, being formed in the interior of the crankcase 40 of the base block 30 and connecting, to each other, the first and the second duct portion 11, 21 and forming the compressed air duct CA.

Still according to the present disclosure, the first and the second cylinder block 10, 20 are each provided with a ventilation chamber 13, 23, defined between the respective cylinder C1, C2 and the respective duct portion 11, 21, and which is open at opposite sides, according to a direction coinciding with that of the crankshaft 70.

The provision of the ventilation chambers 13, 23 allows the compressed air duct CA to remain adequately isolated from the cylinders C1, C2 by a plenum through which is passed part of the air flow produced by the axial flow fan V, guaranteeing an efficient refrigeration, not only of the motor 80, but also of the cylinders C1, C2, besides maintaining the compressed air duct CA thermally little susceptible to the heat sources generated by the operation of both the first and the second piston P1, P2, during the work of compressing the compressed air in the interior of the cylinders C1, C2.

As already mentioned hereinbefore, the construction defined above eliminates the provision of an external air duct for connecting the two stages of the compressor, by reducing its external dimensions and the number of mounting pieces, at the same time maintaining the third duct portion in direct contact with the lubricant oil of the crankcase 40, allowing the latter to remove heat from the compressed air being transferred from the first to the second compression stage, transferring the heat absorbed by the lubricant oil to the refrigeration air flow passing by the exterior of the cylinder blocks 10, 20 and of the base block 30, also through the ventilation chambers 13, 23.

In order to maintain the construction the most compact possible, the cylinder head 50, 60, respectively of the first and of the second cylinder C1, C2 has an end wall 53, 63 incorporating, in a single piece, refrigeration fins 53*a*, 63*a* turned to the inside of the respective cylinder head 50, 60, increasing the surface area for heat exchange with the forced air flow produced by the fan V, without increasing the height of said cylinder heads 50, 60.

The construction of the present compressor is completed with the provision of a tubular fairing 90, surrounding laterally, superiorly and inferiorly, with a radial gap, the fan V, the motor 80, partially the base block and also, laterally and superiorly, the first and the second cylinder block 10, 20, and having one end, confronting the fan V, closed by a grid 95, through which is admitted the air drawn by the fan V, e and an opposite open end, surrounding, laterally and superiorly, partially and in the longitudinal direction of the compressor assembly, the first and the second cylinder block 10, 20 and, laterally, the base block 30.

Aiming at increasing even more the thermal exchange between the cylinder blocks 10, 20 and the forced air flow produced by the fan V, the first and the second cylinder block 10, 20, incorporate, generally in a single piece, external radial fins 15, 25, contained in the interior of the fairing 90. For the same reason of providing a greater efficient thermal exchange with the forced air flow, the base block 30 incorporates, generally in a single piece, lower fins 35, projecting outwardly therefrom and to underneath the crankcase 40, in a region of the base block 30 external to the adjacent open end of the fairing 90. The lower fins 35 promote a better refrigeration of the base block 30 and of the eventual lubricant oil contained therein, by the forced air flow produced by the fan V.

Figure 2:
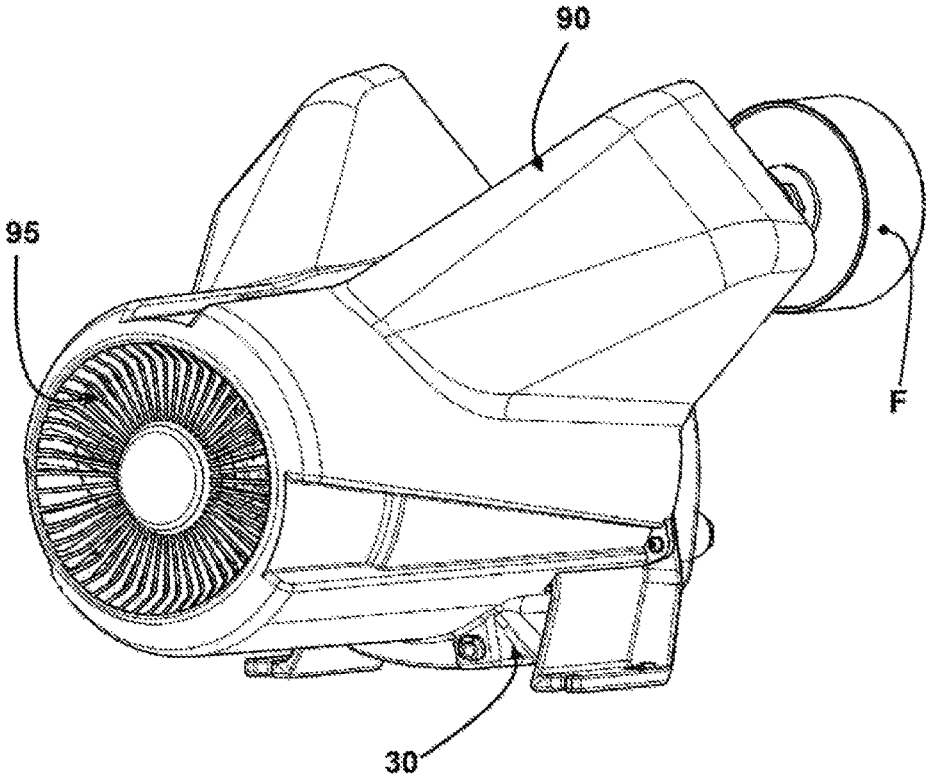
FIG. 2 represents an opposite end perspective view of the air compression of FIG. 1.
Figure 3:
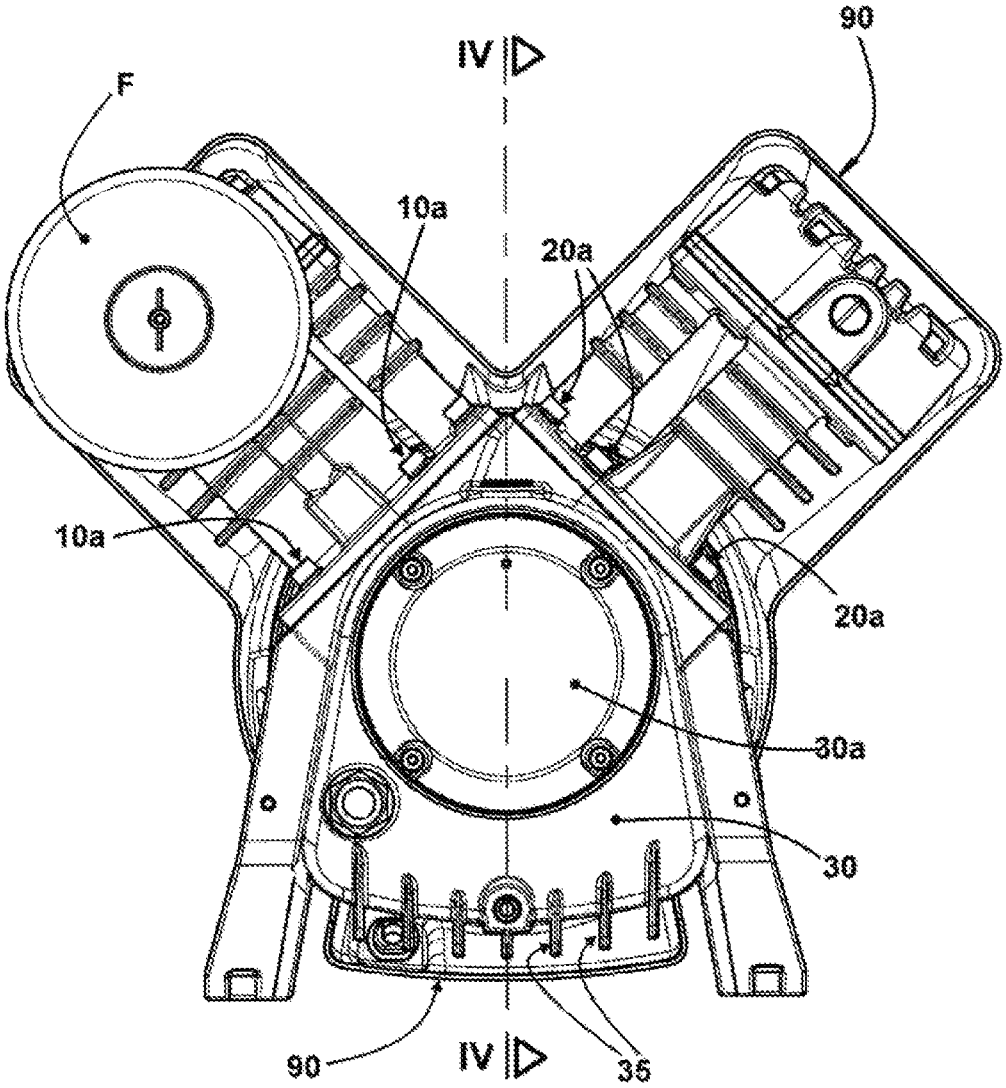
FIG. 3 represents an end view of the air compressor of the present disclosure, taken from the end adjacent to the cylinder blocks and illustrated in FIG. 1, in which the protecting fairing is open.
Figure 4:
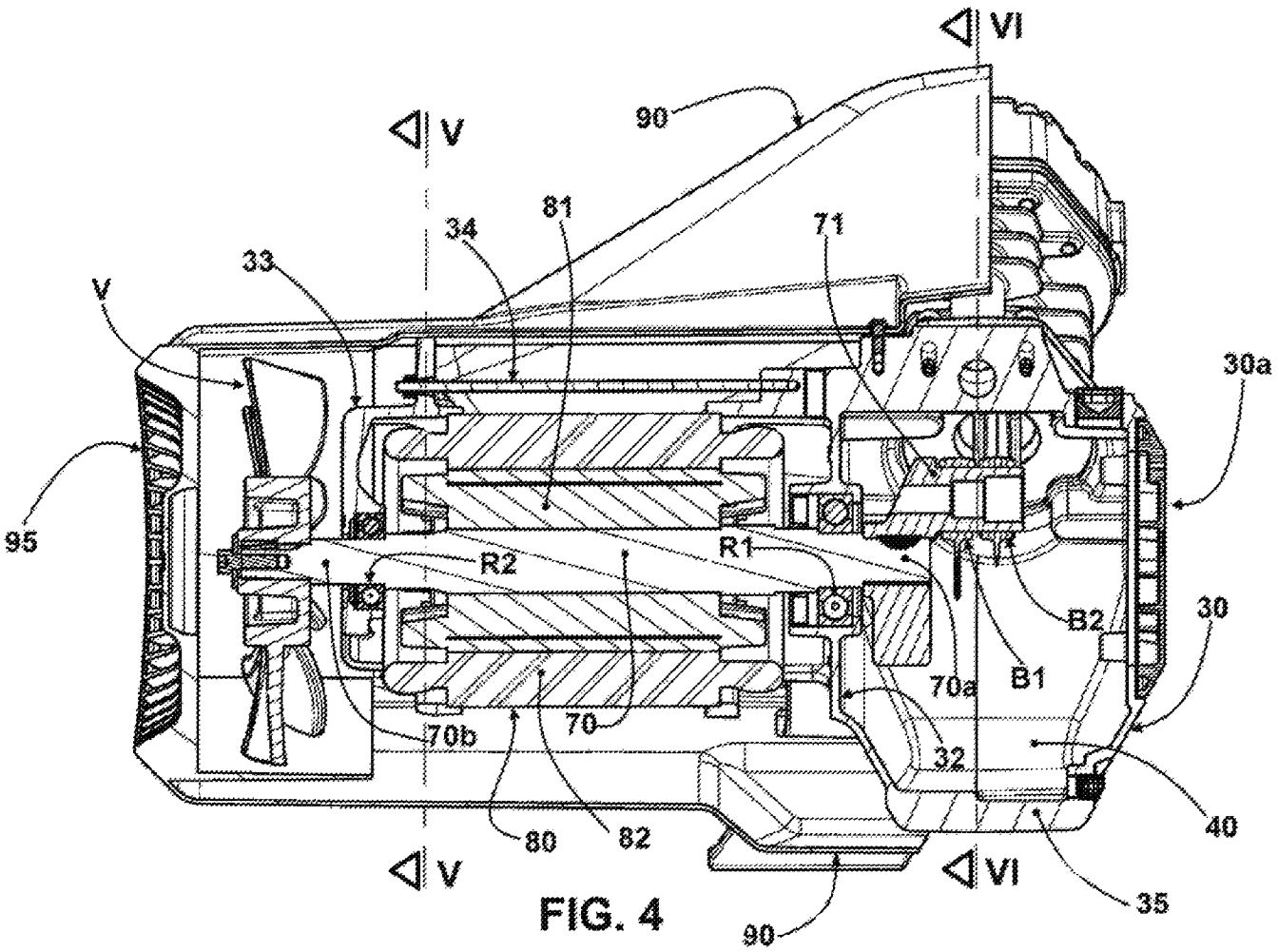
FIG. 4 represents a longitudinal sectional view of the compressor, when taken according to the arrows IV-IV of FIG. 3.
Figure 5:
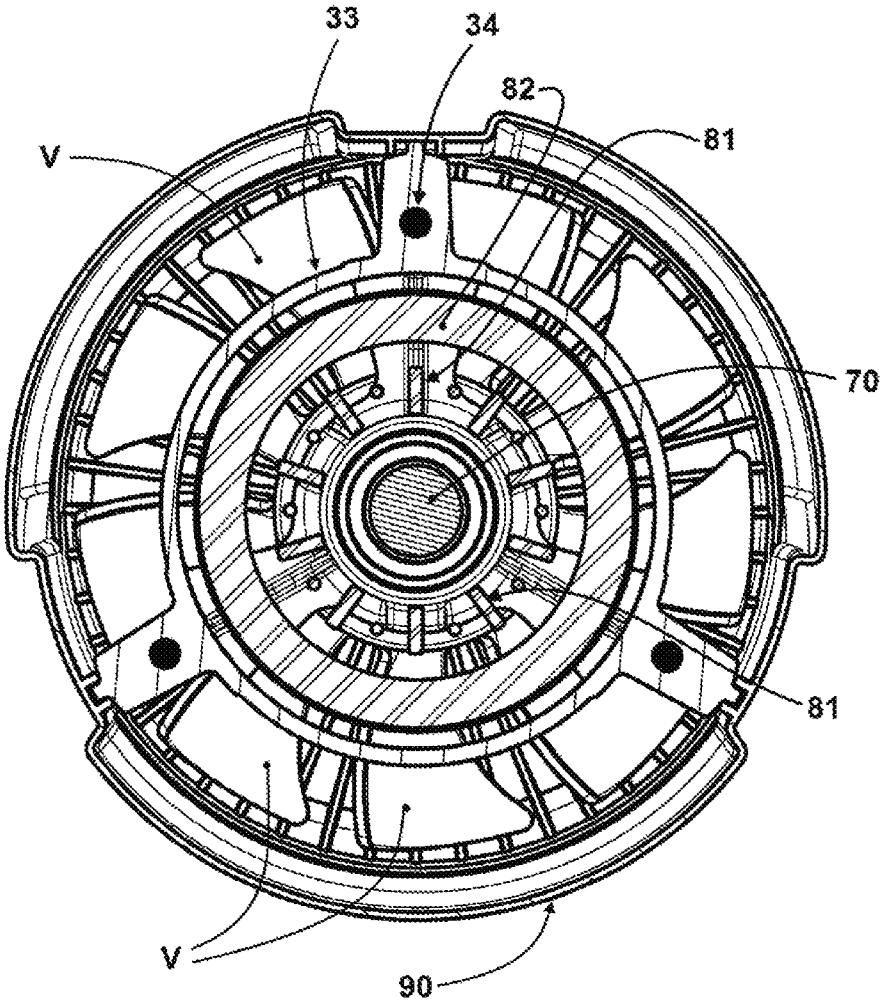
FIG. 5 represents an enlarged cross-sectional view of the compressor, taken according to arrows V-V of FIG. 4.
Figure 6:
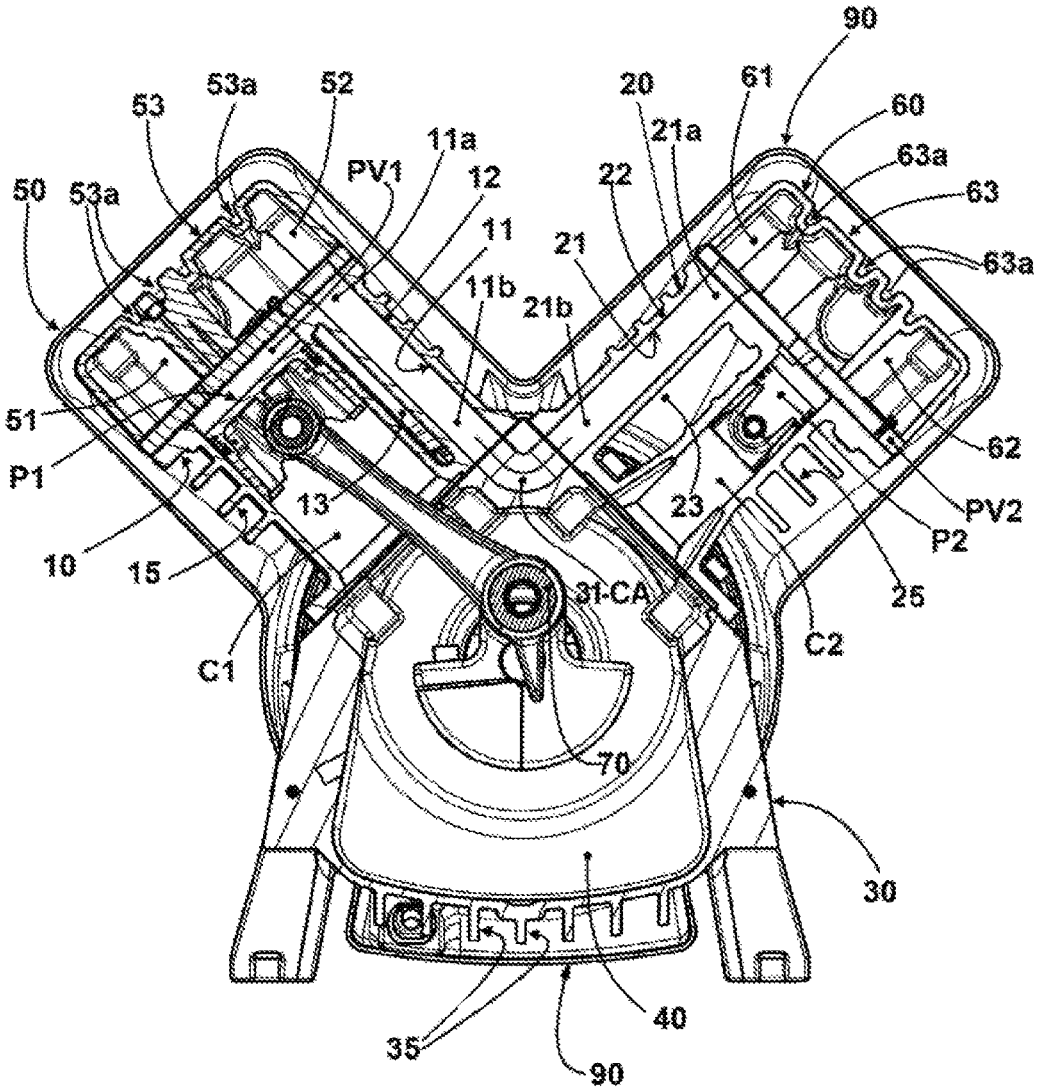
FIG. 6 represents a cross-sectional view of the compressor, taken according to arrows VI-VI of FIG. 4.

As illustrated in FIGS. 1, 2 and 3, the compressor is further conventionally provided with an air filter F, directly mounted in the exterior of the first cylinder block 10 and externally to the open end of the fairing 90, for making the atmospheric air, which will be compressed, to pass through the filter F before being directly admitted in the suction chamber 51 of the first cylinder C1.

While only one way of carrying out the present disclosure has been described and illustrated herein, it should be understood that modifications as to the shape and relative positioning of the elements can be made, without departing from the constructive concept defined in the claims that accompany the present specification.

The invention claimed is:

1. A two stage air compressor, having a first cylinder block and a second cylinder block, arranged in a V-shape defining, respectively, a first cylinder and a second cylinder, and being affixed on a base block which defines a crankcase, each cylinder having a free end closed by a respective valve plate and by a respective cylinder head which defines respective suction chambers and discharge chambers, each cylinder housing a respective piston driven by a crankshaft housed and supported on the base block, wherein the first and the second cylinder blocks incorporate, respectively, in a single piece, a first duct portion and a second duct portion longitudinally provided along the respective cylinder block, between an external wall portion of the latter, turned to the other cylinder block, and the respective cylinder, the first and second duct portions having an outer end open to the interior of the cylinder head of the respective cylinder, and an inner end turned to the base block, the latter incorporating, in a single piece, a third duct portion connecting the inner ends of the first and of the second duct portions, and forming, therewith, a compressed air duct connecting the discharge chamber of the first cylinder to the suction chamber of the second cylinder, the third duct portion being in the form of an elbow, defined in the interior of the crankcase of the base block and connecting the first and the second duct portions to each other, the first and the second cylinder blocks are provided, each one, with a ventilation chamber defined between the respective cylinder and the respective duct portion and open at opposite sides according to a direction coinciding with that of the crankshaft, each ventilation chamber isolating a respective one of the first and second duct portions from the respective first and second cylinders by a plenum through which air passes.

2. The compressor, according to claim 1, wherein the cylinder head of each of the first and of the second cylinders has an end wall incorporating, in a single piece, cooling fins turned to the interior of the respective cylinder head.

3. The compressor, according to claim 2, wherein the crankshaft projects outwardly from the base block and is coupled to an electric motor and to a fan of axial flow, and further comprising a tubular fairing, surrounding laterally, superiorly and inferiorly, with a radial gap, the fan, the motor, partially the base block, and also, laterally and superiorly, the first and the second cylinder blocks and having one end, confronting the fan, closed by a grid, and an open opposite end surrounding, laterally and superiorly, partially and in the longitudinal direction of the compressor, the first and the second cylinder blocks and, laterally, the base block.

4. The compressor, according to claim 3, wherein the base block incorporates lower fins, which project outwardly therefrom and to underneath the crankcase, in a region of the base block external to the adjacent open end of the fairing.

5. The compressor, according to claim 1, wherein the crankshaft projects outwardly from the base block and is coupled to an electric motor and to a fan of axial flow, and further comprising a tubular fairing, surrounding laterally, superiorly and inferiorly, with a radial gap, the fan, the motor, partially the base block, and also, laterally and superiorly, the first and the second cylinder blocks and having one end, confronting the fan, closed by a grid, and an open opposite end surrounding, laterally and superiorly, partially and in the longitudinal direction of the compressor, the first and the second cylinder blocks and, laterally, the base block.

6. The compressor, according to claim 5, wherein the first and the second cylinder blocks incorporate external radial fins contained in the interior of the fairing.

7. The compressor, according to claim 6, wherein the base block incorporates lower fins, which project outwardly therefrom and to underneath the crankcase, in a region of the base block external to the adjacent open end of the fairing.

8. The compressor, according to claim 5, wherein the base block incorporates lower fins, which project outwardly therefrom and to underneath the crankcase, in a region of the base block external to the adjacent open end of the fairing.

9. The compressor, according to claim 1, wherein the cylinder head of each the first and of the second cylinders has an end wall incorporating, in a single piece, cooling fins turned to the interior of the respective cylinder head.

10. The compressor, according to claim 9, wherein the crankshaft projects outwardly from the base block and is coupled to an electric motor and to a fan of axial flow, and further comprising a tubular fairing, surrounding laterally, superiorly and inferiorly, with a radial gap, the fan, the motor, partially the base block, and also, laterally and superiorly, the first and the second cylinder blocks and having one end, confronting the fan, closed by a grid, and an open opposite end surrounding, laterally and superiorly, partially and in the longitudinal direction of the compressor, the first and the second cylinder blocks and, laterally, the base block.

11. The compressor, according to claim 10, wherein the base block incorporates lower fins, which project outwardly therefrom and to underneath the crankcase, in a region of the base block external to the adjacent open end of the fairing.

12. The compressor, according to claim 1, wherein the crankshaft projects outwardly from the base block and is coupled to an electric motor and to a fan of axial flow, and further comprising a tubular fairing, surrounding laterally, superiorly and inferiorly, with a radial gap, the fan, the motor, partially the base block, and also, laterally and superiorly, the first and the second cylinder blocks and having one end, confronting the fan, closed by a grid, and an open opposite end surrounding, laterally and superiorly, partially and in the longitudinal direction of the compressor, the first and the second cylinder blocks and, laterally, the base block.

13. The compressor, according to claim 12, wherein the base block incorporates lower fins, which project outwardly therefrom and to underneath the crankcase, in a region of the base block external to the adjacent open end of the fairing.

14. The compressor, according to claim 1, wherein each ventilation chamber has a length extending in a direction parallel to a respective duct portion, and a width extending in a direction between the respective cylinder and the respective duct portion, the length being greater than the width.

15. The compressor, according to claim 1, wherein the base block has an outer end closed by a lid, and an opposite end closed by an end wall, the end wall being annularly shaped to define a housing for a first rolling bearing, the end wall carrying a support spaced from the end wall and affixed thereon through a plurality of longitudinal struts.

* * * * *